United States Patent [19]

Lyons et al.

[11] 4,191,338

[45] Mar. 4, 1980

[54] INFEED DISC FOR DISC-TYPE REFINERS

[75] Inventors: William E. Lyons, Springfield; John J. Egan, Dayton, both of Ohio

[73] Assignee: The Bauer Bros. Co., Springfield, Ohio

[21] Appl. No.: 897,583

[22] Filed: Apr. 19, 1978

Related U.S. Application Data

[63] Continuation-in-part of Ser. No. 803,067, Jun. 3, 1977, abandoned.

[51] Int. Cl.[2] ..... B02C 17/12

[52] U.S. Cl. ..... 241/245; 241/251

[58] Field of Search ..... 241/244, 245, 246, 247, 241/248, 249, 250, 251

[56] References Cited

U.S. PATENT DOCUMENTS

| | | | |
|---|---|---|---|
| 817,610 | 4/1906 | Adelsperger | 241/248 |
| 2,561,043 | 7/1951 | Ayers | 241/245 X |
| 3,589,629 | 6/1971 | Michel et al. | 241/251 |
| 3,765,613 | 10/1973 | Steiniger | 241/251 |
| 3,889,890 | 6/1975 | Horstman | 241/245 |

*Primary Examiner*—Howard N. Goldberg
*Attorney, Agent, or Firm*—Jerome P. Bloom

[57] ABSTRACT

An infeed disc for a disc refiner has infeed passages which are circularly spaced by portions thereof which define spokes. The spokes and the passages have special characteristics. The center line of each passage is skewed with reference to the axial center line of the disc, in both an axial and a circular sense, and thereby curved, causing the passage to be essentially curved to provide a circular offset of the openings from the respective ends of each passage. The disc is further characterized by a non-radial skewed orientation of its spokes, the center line of each spoke being angularly inclined to a plane which is radial to and includes the central axis of the disc. The centers of the respective axially spaced infeed and operating surface portions of the spokes are offset one from the other, in a circular sense. The leading and trailing edges of each infeed passage at the operating face of the disc are also each respectively offset from the corresponding leading and trailing edges at the infeed face of the disc, in a circular sense, about the central axis of the disc. One wall surface of each spoke provides the leading wall portion of one of the passages, having regard to direction of rotation of the disc in use, and is distinguished by a longitudinally extended offset at the entrance end of the passage of which it forms a part. This offset is in the direction of disc rotation and creates an insuction effect as the disc rotates.

19 Claims, 7 Drawing Figures

INFEED DISC FOR DISC-TYPE REFINERS

This application is a continuation-in-part of applicant's co-pending application Ser. No. 803,067, filed June 3, 1977, now abandoned for IMPROVED INFEED DISC FOR DISC-TYPE REFINERS.

BACKGROUND OF THE INVENTION

This invention relates to a new and improved infeed disc having a particularly advantageous application to a double disc refiner, with reference to which it will be herein described, but only by way of illustration and not by way of limitation.

The art of double disc refining has long been plagued by problems in the refining process stemming from the development of large amounts of steam between the refining surfaces of the opposed discs. The steam so developed tends inherently to back flow into the eye of the double disc refiner and to interfere with and even block incoming material seeking to reach the disc refining surfaces.

In conventional double disc refiners the material to be refined is directed to the disc refining surfaces by way of passages of its infeed disc. When the material flow is interfered with or blocked, it causes undesirable variations in motor load and adversely affects the quality of the stock produced by the refiner.

In the study of the aforementioned problems which resulted in the present invention it was determined that heretofore infeed discs have been required to have an ability to operate either in a clockwise or in a counter clockwise direction and to have spokes each of which is generally symmetrical about its axial center line and radial thereto. It was unexpectedly subsequently found that a change in the form and character of the spokes and thereby the material infeed passages could materially contribute to the elimination of the aforementioned problems.

SUMMARY OF THE INVENTION

Embodiments of the invention provide an infeed disc for a disc refiner comprising a plate having a first aperture for mount thereof to and rotation by a drive shaft. The plate has an infeed face and an operating face and at least one additional aperture forming an infeed passage the entrance end of which opens from the infeed face and the discharge end of which opens from the operating face. The passage is skewed with reference to both faces and the axial center line of the disc the axial center line of each passage is curved from one end thereof to the other, providing thereby that the passage is essentially curved and that the ends of the passage are circularly offset, one from the other. In preferred embodiments the discharge end of the passage is offset from its entrance end in a direction counter to the intended direction of dics rotation in use. Correspondingly the entrance end of each passage leads the discharge end on rotation of the disc in use. Where there are a plurality of passages, they are circularly spaced by non-radial spokes each of which is skewed so as to have the surface portion thereof in said operating face circularly offset from its surface portion which lies in the infeed face.

Considering the direction of disc rotation the leading surface portion of each spoke provides a trailing surface portion of a passage, while the trailing surface portion of the spoke provides the leading surface of the following passage. The leading wall portion of each passage is distinguished by a longitudinally extended offset at the entrance end of the passage of which it forms a part which creates an insuction effect as the disc rotates in use. The offset in this case is in the direction of disc rotation.

It is therefore a primary object of the present invention to provide an infeed disc for a disc refiner which is more efficient and satisfactory in use, adaptable to a wider variety of applications and unlikely to produce, in use thereof, serious malfunction.

Another object is to provide an infeed disc for a disc refiner having infeed passages circularly spaced immediately about its hub and skewed so their axial center lines are curved and said passages are thereby essentially curved as they extend from the infeed to the operating face of the disc in a direction circularly of and about the axial center line of the disc and skewed to the infeed and operating faces of the disc.

A further object is to provide an infeed disc having infeed passages circularly spaced by spokes which have a cocked non-radial orientation with respect to the axial center line of the disc.

Another object is to provide a refiner disc with material infeed passages so configured as to provide for material feed through said passages in a manner minimizing the potential for interference with the material flow by reversely flowing steam developed in use of the refiner in which the disc is embodied.

Another object is to provide a refiner disc having apertures which form infeed passages separated, in a circular sense, by spokes which are non-radial and skewed from their infeed to their discharge faces so as to angle, in a circular sense, from their inlet to their discharge ends, in a direction counter to the direction of rotation of the disc in use.

An additional object of the invention is to provide an improved infeed disc for a refiner possessing the advantageous features, the inherent meritorious characteristics and the means and mode of operation herein described.

With the above and other incidental objects in view as will more fully appear in the specification, the invention intended to be protected by Letters Patent consists of the features of construction, the parts and combinations thereof, and the mode of operation as hereafter described or illustrated in the accompanying drawings, or their equivalents.

Referring to the drawings wherein some but not necessarily the only forms of embodiment of the invention are illustrated, FIG. 1 is a plan view of the infeed or inlet face of a disc per the present invention;

Like parts are indicated by similar characters of reference throughout the several views.

Figure 1:
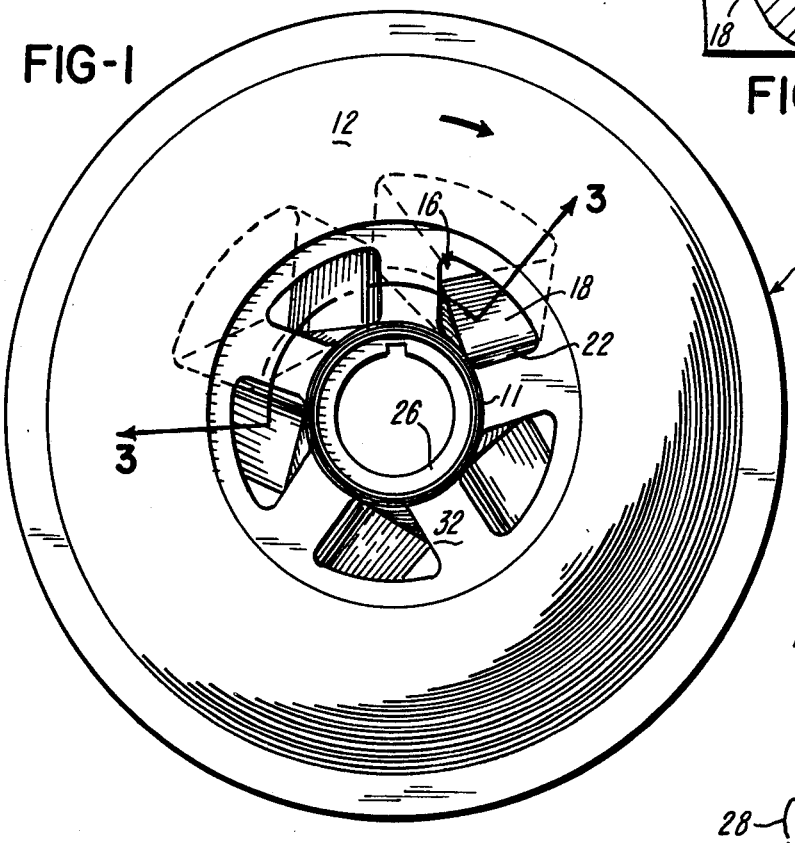

The construction of the refiner discs, other than by reason of the changes dictated by the special configurations of their spokes and infeed passages, as illustrated, is conventional. The discs will therefore be described only to the extent necessary for an understanding of the present invention.

In the embodiment of FIGS. 1–4, the infeed disc 10 has a circular peripheral outline and includes a material receiving or infeed face 12, a reversely facing discharge or operating face 14 and a central through passage 26, the latter of which is rimmed by what may be considered its hub portion 11. The operating face 14 has an annular recess 13 at a location adjacent and immediately inward of its outer peripheral edge. The recess 13 is adapted to nest a series of refiner plates 15, the operating surfaces of which project to lend the disc refining capabilities.

Figure 4:
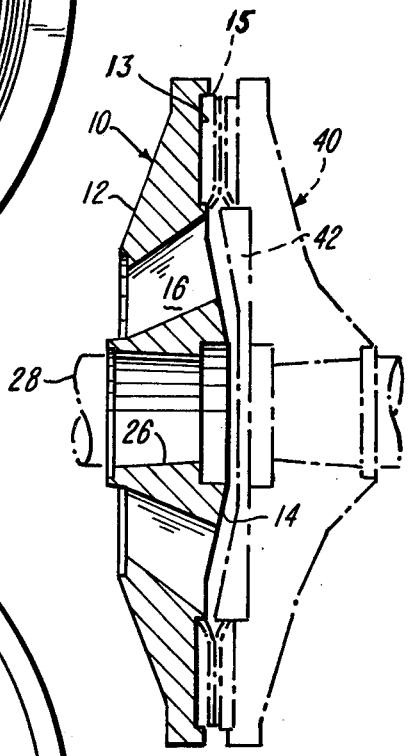
FIG. 4 is a generally diagrammatic illustration of a pair of opposed refiner discs such as provided in a double disc refiner the infeed disc of which is that illustrated in FIGS. 1-3.

As shown in FIG. 4, in its use in a double disc refiner, the disc 10 is paired with and disposed in an opposed facing relation to a second somewhat similar disc 40 to place their respective refiner plates in a closely spaced immediately facing relation for the refining of material which is delivered therebetween. The refining plates dispose peripherally of the eye 42 of the refiner, the eye 42 being determined by that area of the space between the discs which is bounded by the inner periphery of the applied refiner plates.

The infeed disc per the present invention has a plurality of through apertures defining material infeed passages 16. The passages 16 open at their entrance end from the infeed face 12. As will be further apparent, the center line of each passage is defined by a line connecting the centers of its entrance and discharge ends which forms a curve and provides an offset of one passage end from the other in a generally circular sense, about and with reference to the central axis of the disc 10.

Figure 2:
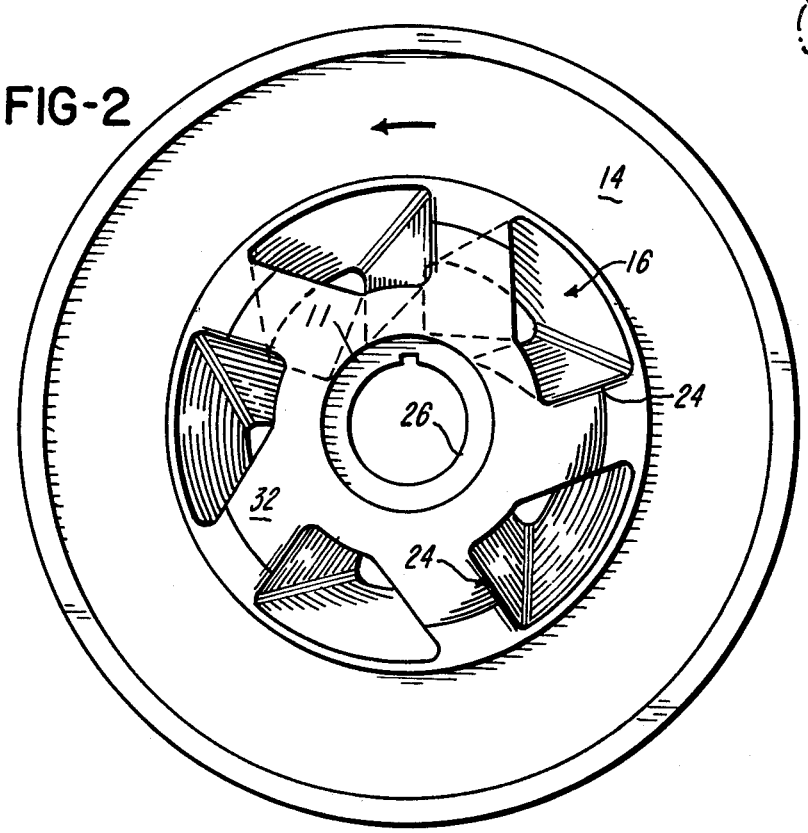
FIG. 2 is a plan view of the disc operating or discharge face.

The passages 16 have their entrance ends circularly spaced, adjacent and immediately about the hub portion 11. The discharge ends of the passages 16 open through an area of the operating face 14 located radially outwardly of their entrance ends and immediately inward of the plates 15. As seen in FIGS. 1 and 2, the discharge end of each passage 16 is circularly offset from its entrance end in a sense circumferential to the central rotational axis of the disc. Viewing the infeed face of the disc 10, the required and intended direction of its rotation, in use, is clockwise (see FIGS. 1 and 2). The circular offset of the discharge end of each infeed passage is counter to this intended direction of disc rotation.

In a circular sense, the formation of the passages 16 produces in the body of the disc 10 a series of spokes 32. Five such spokes are illustrated.

As seen in FIGS. 1–4 each of the spokes 32 is skewed with reference to the axial center line of the disc, both in a radial sense and in a sense circumferentially thereof and with reference to the disc faces 12 and 14. The skewing of the spokes provides that each thereof is cocked with reference to said axial center line and that those portions thereof which form part of the surface 14 are circularly offset, in a direction counter to the intended direction of the disc rotation, from those portions thereof which form part of the surface 12. The axial center line of each passage 16 is correspondingly skewed and curved, the center line being defined as noted previously by a line connecting the centers of the inlet opening to and the discharge opening from the passage 16. Thus the axial center lines of the passages 16, as they are circularly spaced about and in radially spaced concentric relation to the central aperture for the drive shaft 28, will angle from the infeed face to the operating face of the disc in directions uniformly counter to the direction of disc rotation.

Considering the required direction of disc rotation, each passage 16, viewing the infeed end thereof, includes a leading wall portion 18 provided by the trailing surface of one spoke 32 and a trailing wall portion 20 provided by the leading surface of a following spoke 32.

Figure 3:
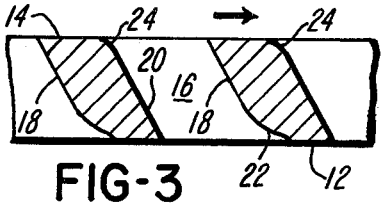
FIG. 3 is a sectional view taken on line 3—3 of FIG. 1, developed to produce a showing of sections of the disc spokes in a common plane, for the purpose of illustrating the leading and trailing wall portions of an infeed passage of the disc.

Referring to FIG. 3, the leading wall portion 18 of each passage 16 is inclined to that portion of the disc face 14 from which it opens at an angle of approximately 60° and the trailing wall portion 20 is inclined at generally the same angle. The surfaces of both the leading wall portion and the trailing wall portion have their edges at the operating face 14 trailing their corresponding edges at the infeed face 12. The surface of the wall portion 18 shown is generally planar in configuration except for an offset 22 at its entrance end. The end portion of the offset 22 most adjacent the face 14 departs from the generally planar surface configuration of the wall portion 18 by being curved therefrom in the normal direction of disc rotation in a generally convex fashion. This curve is continued by a reversely curved portion of the offset which extends to the face 12. This gives the entrance end of the wall portion 18 an offset having a smoothly curved contour which opens somewhat the entrance end of the passage. As will be further described, the offset 22 in each passage 16 will, in the rotation of the disc 10, produce a low pressure pocket giving an initial directional influence and insuction effect to material in the vicinity of the entrance end of the passage of which it forms a part which is supplemental to that provided by the centrifugal force produced on rotation of the disc.

The trailing wall surface portion 20 of each passage 16 also has a generally planar configuration and is so inclined to that portion of the operating face 12 from which the entrance end of the passage opens as to form therewith an angle of approximately 60°. The surface 20 departs from its generally planar configuration at its discharge end 24 in a manner to provide that its discharge extremity is bent convexly, in the configuration of a smooth curve of generally uniform radius, towards the exit end of the leading surface 18 of the following passage 16.

The inner and outermost walls of each passage 16 are radially spaced and arcuately configured and in each of the transverse planes thereof they are generally concentric to each other and the axial center line of the disc, though the axial center line of each passage is skewed, curved and circularly offset from its inlet to its discharge end in a direction counter to that of the disc rotation so that, as seen in FIG. 3, the end of the axial center line of each passage at the face 12 leads the opposite end thereof during disc rotation in use.

The provision of a skewing of the passages 16 as described will per se cause a better and more effective movement therethrough of material delivered to the vicinity of the entrance ends of the infeed passages under the influence of the centrifugal force developed in the rotation of the disc 10 in use. Contributing to a significant accelerating of the movement of such material is the angularity of the leading and trailing surfaces of the bounding walls of the passages 16 as determined by their angle of inclination to the respective faces 12 and 14 of the disc 10. It is here noted that 60° as above specified is a preferred angle but, under certain conditions, this particular angle may vary to the extent of plus or minus 15°.

In the use of the disc 10 the offsets 22 in the respective infeed passages 16, as noted, give both force and direction to the material which is delivered, usually, in accordance with conventional practice, by a gravity feed thereof to the entrance ends of the infeed passages 16. What happens during rotation of the disc 10 under such conditions is that the high speed rotation of the disc produces a low pressure area in each passage particularly defined in that portion defined by its offset which influences the movement of the material to be refined which is adjacent the entrance to each infeed passage to enter the passage under the influence of forces which tend to draw it in the direction of the leading surface 18 of the passage. As the disc rotates, the material so drawn into each passage will gradually move across the passage in the direction of its discharge end and towards the trailing surface 20 and on reaching the same will move adjacent thereto and follow the contour thereof to discharge over the smoothly convex surface of its discharge end 24. The effect of the contour of the discharge end 24 of each trailing surface 20 is not only to lend an accelerating influence to the movements of material from the passage but to give it directional influence to move immediately outward to the refining surface or surfaces with which it may be associated. The net effect of the described flow of material to and through the passages 16 and outwardly therefrom under the influence of their shape, in the rotation of the disc 10, is such to provide the disc with an ability to feed the material to be refined with accelerating and directional influences not heretofore found in or within the capabilities of infeed discs of the prior art wherein the infeed passages are conventionally provided.

An inherent benefit of the controlled movement of material as just described is that the accelerating and directional influences provided assist the material in minimizing the potential for interference with its flow by steam developed in a refining operation which tends to move into the eye of a refiner and to backflow through the infeed passages.

Particular attention is directed to the fact that with the departure from conventional practice as to the character and arrangement of spokes formed in an infeed disc as shown in the embodiment of FIGS. 1–4, passages are provided with center lines which curve and effect a form and configuration of the passages which increases the speed and effectiveness of the infeed of material to a refiner in which the infeed disc is embodied. This permits the infeeding material to pass the steam developed in the operation of the refiner as such steam moves reversely through the infeed passages. The net effect of the skewing of the spokes and the offset in their trailing surface portions is to reduce resistance to and interference with material inflow to the infeed passages of the disc.

Figure 5:
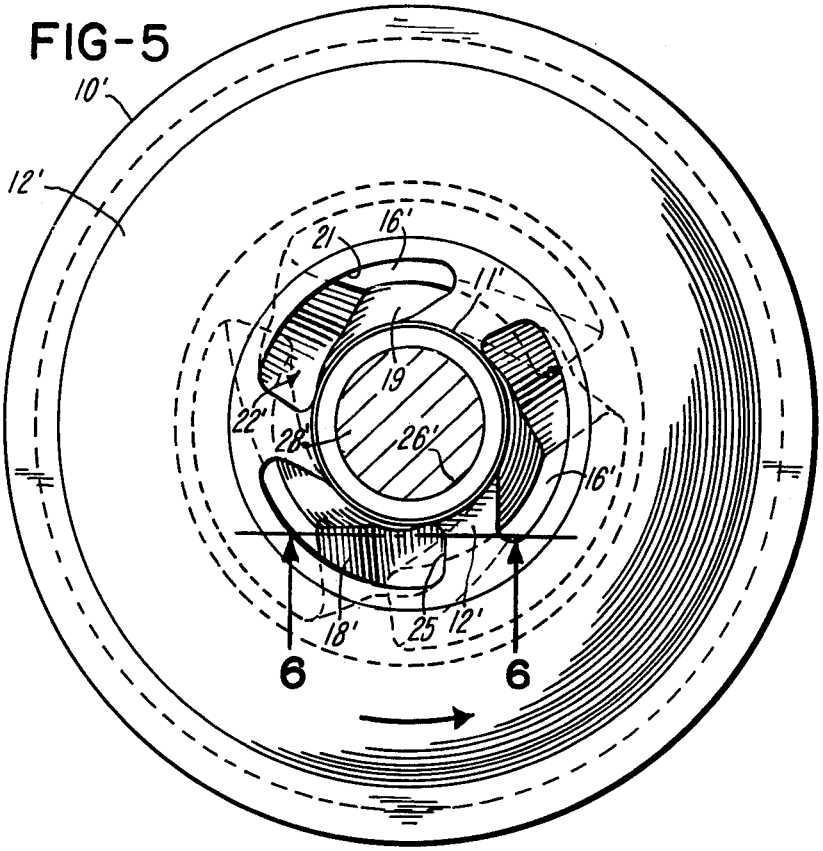
FIG. 5 is a plan view of the infeed face of a disc such as shown in FIG. 1 modified to provide it with spokes and infeed passages configured to constitute a particularly preferred embodiment of the invention.
Figure 6:
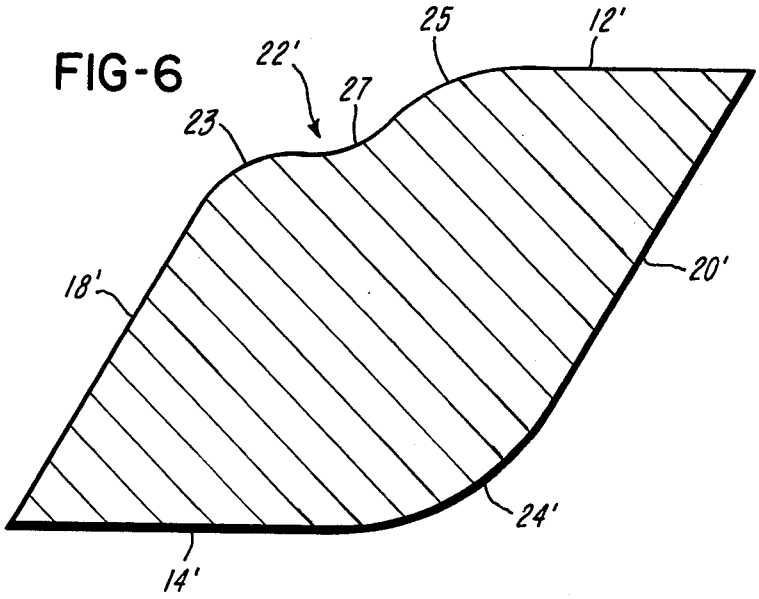
FIG. 6 is an enlarged cross sectional view of each spoke of the disc of FIG. 5 as viewed by way of example on line 6—6 thereof, illustrating the leading and trailing surfaces of the spoke as well as those surface portions respectively forming a part of the infeed face and the operating face of the disc.
Figure 7:
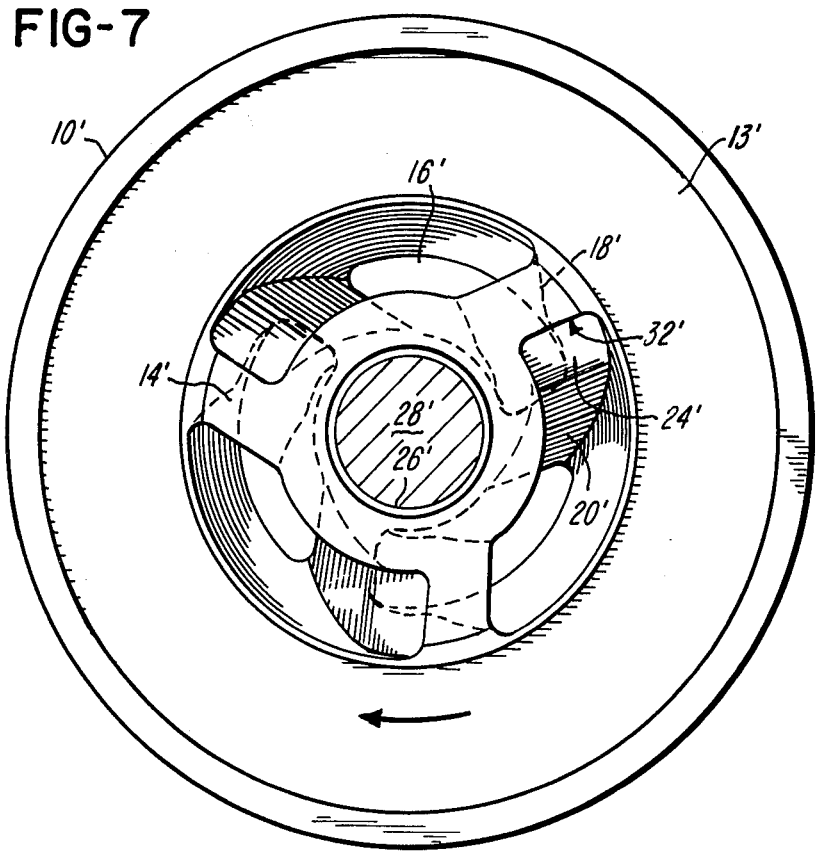
FIG. 7 is a plan view of the discharge face of the disc of FIG. 5.

The most preferred embodiment of the invention is an infeed disc illustrated in FIGS. 5–7, wherein parts similar to those of the embodiment of FIGS. 1–4 are identified by like numerals having a prime symbol. This infeed disc 10' is designed to rotate counterclockwise as seen in FIG. 5 of the drawings. It has a material receiving or infeed face 12', an operating face 14' and a central aperture 26' accommodating the driving end of shaft 28' to which it mounts. The aperture 26' is rimmed by the disc hub portion 11'. The operating face 14' has an annular recess 13' just within and concentric to its outer peripheral edge. Recess 13' is designed to nest a ring of refiner plates such as the plates 15 of the disc embodiment first described, which in use of the disc 10' provide an annular, relatively projected, refining surface which positions in opposed closely spaced facing relation to the similar surface on a disc such as the disc 40 as shown in FIG. 4 to rim the eye of the refiner in which the discs are embodied.

The disc 10' is formed with only three infeed passages 16' provided by through apertures which are circularly spaced about and immediately outward of the aperture 26'. The passages 16' which open at their entrance end from the infeed face 12' and at their discharge end from the operating face 14' are skewed to have their center lines curved and to form the passages about the axial center line of the disc 10' and to its infeed and with reference operating faces in a manner similar to the passages 16. Thus the discharge end of each passage 16' is offset in a circular sense from its entrance end in a direction counter to the intended direction of rotation of the disc 10'. By the same token the centers of the entrance and discharge openings of each passage are similarly offset as they form terminal points of the axial center line of the passage. The arcuate extent of each passage 16' (about the central axis of the disc) is preferably, in this case, about 100° plus or minus 10°.

The passages 16' are circularly spaced by spokes 32' which are cocked and non-radial to the central axis of the aperture 26'. Each spoke has an identical configuration.

The wall surface bounding each passage 16', having regard for the direction of rotation of the disc 10' in use, includes a leading wall portion 18' provided by the trailing surface of a spoke 32' and a trailing wall portion 20' provided by a leading surface of the next following spoke 32'. The facing wall portions 18' and 20' of each passage are joined at their respective radially innermost and radially outermost edges by concentric, arcuate, radially spaced wall surface portions 19 and 21.

Except for its portion adjacent the entrance end of the passage of which it forms a part, the angled skewed surface of wall portion 18' is planar and inclined generally at an approximately 60° angle to the surface 14'. Adjacent its entrance end the wall portion 18' is distinguished by an offset 22' is the intended direction of disc rotation which in configuration is somewhat different than the offset 22.

The contour of the offset 22', in a longitudinal sense, is provided by three, relatively short, curved surface portions, including a concavely curved portion centered between two convexly curved portions 25 and 23. The convexly curved surface portion 23 which is innermost of the passage 16' merges smoothly at one end with and tangential to the generally planar surface of the major extent of wall portion 18', at the end thereof most adjacent the entrance end of the passage, and immediately curves away therefrom in the direction of rotation of the disc in use. The concavely contoured surface portion 27 forms an extension of the surface portion 23 curving towards the infeed face 12'. The portions 23 and 27 are formed on generally the same radius. The convex curve of the portion 25 is formed on a larger radius than portions 23 and 27 and provides a relatively flatly curved surface forming an extension of the surface portion 27 one end of which is tangential to the end of surface portion 27 most adjacent the entrance end of the passage 16' and the other end of which extends in the intended direction of disc rotation and merges with and tangential to the infeed surface 12'.

The contour of the entrance end of wall portion 18' provides a low pressure pocket or offset 22' therein which not only expands the entrance end of the passage 16' in the direction of the disc rotation but accelerates the entrance of material fed to the infeed face of the disc as it rotates. Not only this but by reason of the curved surface portion 25 followed by the concave portion 27 the entrance induced is rendered essentially non-turbulent as well as smooth in character. The directed flow of the infed material is even better controlled by the contour of the offset 22' than that of the offset 22. Note in FIGS. 5 and 6 that on disc rotation the surface portion 25 will produce a general inclination of the initially induced inflow of material to cause it to move at an angle of about 45° to the infeed surface 12' and thereafter the surfaces 27 and 23 will smoothly advance the flow in a directed fashion to accelerate its movement through the passage and to the trailing surface 20' thereof at its discharge end. The surface 20' of each passage is planar from the infeed face 12' substantially to its discharge end and this portion is at a 60° angle to the infeed face. At its end 24' adjacent the operating face 14' the surface 20' smoothly and convexly curves, on a relatively large radius, in the direction of the next following passage 16'. The end 24' of the wall surface 20' merges smoothly with and tangential to the surface 14'.

The spokes 32' are of course correspondingly contoured as to their leading and trailing surface portions 20' and 18'.

Thus in the operation of the disc 10', looking at the disc from its infeed side, as the disc is driven at high speed and material to be refined is fed to the infeed face 12', the developed centrifugal force will be enhanced by the low pressure pockets formed in the leading wall portions 18' of the passages 16' (which are the trailing surfaces of the spokes). The effect of this is that as the leading edge of the entrance opening to each passage moves by the fed material an enhanced insuction of the material occurs drawing the material to and over surface portion 25 from which it is guided and accelerated inwardly over the surface portions 27 and 23 by which it is directed at an angle across and further inwardly of the passage in the direction of the wall surface 20' and its discharge end portion 24'. The arrangement, skewing and essential curving of the passages 16' as influenced by the curve of their axial center lines stimulates an outwardly directed and circularly influenced flow of the infed material the discharge of which to the surface of the associated refining plates is quite controlled for optimal reception thereof for refining purposes. At the same time the forceful and directed nature of the inflowing material will be such to minimize possible adverse interference with backflowing steam in the eye of the refiner exit for which will be very adequately provided by those portions of the infeed passages not occupied by incoming solids. It is to be understood of course that in practice and as in the use of conventional infeed discs the amount of material fed to and through the infeed passages is never so great as to fill such passages.

Accordingly, the most desirable result of the invention is that it provides an infeed disc with a capability of effectively operating and delivering material while at the same time permitting the passage of steam therethrough without material interference or blocking of material being delivered, thereby to relieve steam pressure in the eye of the refiner and the possibility of undesirable consequences such as feeder motor overload or variations in refiner motor load.

An unobvious benefit of the invention is that the configuration of the infeed passages inherently provides an increase in throughput capacity of a refiner which together with the relief afforded in respect to relieving conventional steam problems enables a significant advance in the art of refining and processing materials. The invention also provides a potential for expanding the application of disc refining apparatus and control of the properties of their end products.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. An infeed disc for a disc refiner comprising a plate unit having a first aperture for mount thereof to and rotation by a drive shaft, said plate unit having an infeed face and an operating face and at least one additional aperture forming an infeed passage one end of which opens from said infeed face and the other of which opens from said operating face, said passage being skewed and essentially curved as it extends from said one end thereof to the other and said other end of said passage being circularly offset from said one end thereof in a path about said first aperture.

2. An infeed disc as in claim 1 wherein the center of the opening from said one end of said passage is circularly displaced from the center of the opening from said other end thereof to provide thereby that the line between said centers is skewed and curved in a sense about and with reference to the center line of the disc and skewed with reference to a radial plane of said disc including said center line.

3. An infeed disc as in claim 1 wherein there are additional apertures in said plate unit each of which defines one said infeed passage, said infeed passages are circularly and equidistantly spaced and the opening from said other end of each said passage is displaced and circularly offset from a direct alignment with the opening from said one end thereof in a direction counter to the intended direction of rotation of said disc in use.

4. An infeed disc as in claim 1 wherein there are a plurality of said additional apertures each of which defines one said infeed passage, said infeed passages are circularly spaced by portions of said discs which define spokes and each said spoke is skewed with reference to a radial plane of said disc including its rotational axis and to have that portion which lies at the infeed face of the disc offset from that portion which lies at the operating face of the disc, in a sense about said first aperture.

5. An infeed disc as in claim 4 wherein that surface portion of each said spoke which is at the operating face of said disc is circularly offset from that surface portion of said spoke which is at the infeed face of said disc in a direction counter to the intended direction of rotation of said disc in use.

6. A disc as in claim 1 wherein said operating face includes an outer peripheral surface portion arranged to incorporate means defining a refining surface and the center line of said infeed passage as defined by a line which extends between the centers of the openings from said one end and said other end of said passage is inclined to a radial plane embodying a line radial to said disc and extending in the sense of the axial center line of said disc.

7. An infeed disc as in claim 1 wherein said infeed passage has one wall portion thereof configured to include therein a pocket effective on rotation of said disc to create low pressure therein and to apply insuction and directional influence to material approaching said one end of said passage, which influence is supplemental to that provided by centrifugal force per se which is developed on rotation of said disc.

8. Apparatus as in claim 1 wherein there are a plurality of said passages circularly spaced by means defining spokes in said plate unit and each said spoke has one face thereof which bounds one of said passages including a pocket which produces an insuction effect on rotation of the disc which supplements that inherently produced by centrifugal force.

9. An infeed disc for a disc refiner comprising a plate unit having a first aperture for mount thereof to and rotation by a drive shaft, said plate unit having an infeed face and an operating face and at least one additional aperture forming an infeed passage, said passage having the center of one end thereof circularly offset from the center of its other end to provide that its center line is essentially curved from said one end thereof to the other and said passage being defined by bounding wall portions including a leading wall portion and a trailing wall portion, having regard to the direction of rotation of said disc in use, said leading wall portion having therein an offset, said offset being at one end of said passage, and the configuration of said offset providing a low pressure pocket producing an insuction and directional influence on material approaching said one end of said passage which supplements that provided by the centrifugal force per se developed on rotation of said disc.

10. Apparatus as in claim 9 wherein said offset in said passage is in the direction of rotation of said disc in use.

11. An infeed disc for a disc refiner comprising a plate unit having a first aperture for mount thereof to and rotation by a drive shaft, said plate unit having an infeed face and an operating face and at least one additional aperture forming an infeed passage, said passage being defined by bounding wall portions including a leading wall portion and a trailing wall portion, having regard to the direction of rotation of said disc in use, said leading wall portion having therein an offset, said offset being at one end of said passage and having a smoothly arcuate profile formed by a plurality of longitudinally extending curved surface portions of said leading wall portion and the configuration of said offset providing a low pressure pocket producing an insuction and directional influence on material approaching said one end of said passage which supplements that provided by the centrifugal force per se developed on rotation of said disc.

12. Apparatus as in claim 11 wherein said trailing wall portion of said passage has a generally planar configuration and a discharge end arcuately configured to lend smoothness and directional influence to material flowing from said passage.

13. Apparatus as in claim 11 wherein said offset is formed by two reversely directed curved surface portions of said leading wall portion one of which forms an extension of the other.

14. Apparatus as in claim 11 wherein said offset is formed by three curved surface portions of said leading wall portion two of which are convexly configured and the intermediate of which is concavely configured.

15. An infeed disc for a disc refiner comprising a plate unit having a first aperture for mount thereof to and rotation by a drive shaft, said plate unit having an infeed face and an operating face and being formed with a plurality of infeed passages each of which has an axial center line which is essentially curved and one end thereof opening from said infeed face and the other end thereof opening from said operating face, said passages being spaced, in a circular sense, by means defining spokes in said discs which have a non-radial orientation.

16. An infeed disc as in claim 15 wherein each said passage is skewed in both an axial sense and in a sense circumferential to and about the center line of said first aperture.

17. An infeed disc for a disc refiner comprising a plate unit having a first aperture for mount thereof to and rotation by a drive shaft, said plate unit having an infeed face and an operating face and being formed with a plurality of infeed passages each of which is essentially curved, as determined by its axial center line, from one end to the other and has one end thereof opening from said infeed face and the other end thereof opening from said operating face, said passages being spaced, in a circular sense, by means defining spokes in said disc, side surfaces of each said spoke in a circularly following sense respectively defining a trailing wall portion of one said passage and a leading wall portion of a following of said passages, having regard to the direction of rotation of said disc in use, said leading wall portion having a longitudinally extended offset forming a pocket at said one end of said passage formed to provide insuction and directional influence on material approaching said one end of said passage which supplements that provided by centrifugal force per se developed on rotation of said disc in use.

18. Apparatus as in claim 17 wherein said offset in each said passage is in the intended direction of rotation of said disc in use.

19. An infeed disc for a disc refiner comprising a plate unit having a first aperture for mount thereof to and rotation by a drive shaft, said plate unit having an infeed face and an operating face and being formed with a plurality of infeed passages each of which has one end thereof opening from said infeed face and the other end opening from said operating face, said passages being spaced, in a circular sense, by means defining spokes in said disc, side surfaces of each said spoke respectively defining a trailing wall portion of one said passage and a leading wall portion of a following of said passages, having regard to the direction of rotation of said disc in use, and said leading wall portion having therein a longitudinally extended offset at said one end of said passage formed to provide insuction and directional influence on material approaching said one end of said passage which supplements that provided by centrifugal force developed per se on rotation of said disc in use, said offset in each said passage being in the intended direction of rotation of said disc in use and having a smoothly arcuate profile formed by a plurality of longitudinally extending curved surface portions of said leading wall portion.

* * * * *

UNITED STATES PATENT AND TRADEMARK OFFICE

CERTIFICATE OF CORRECTION

PATENT NO. : 4,191,338

DATED : March 4, 1980

INVENTOR(S) : William E. Lyons; and John J. Egan

It is certified that error appears in the above-identified patent and that said Letters Patent are hereby corrected as shown below:

Column 1, line 25, "of" (second occurrence) is corrected to read -- in --;

line 57, "dics" is corrected to read -- disc --.

Column 6, line 56, "is" is corrected to read -- in --.

Signed and Sealed this

*Twenty-fourth* Day of *June 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,191,338

DATED : March 4, 1980

INVENTOR(S) : William E. Lyons et al.

It is certified that error appears in the above—identified patent and that said Letters Patent is hereby corrected as shown below:

Column 6, line 27, after "and" first occurrence, insert -- with reference --.

Signed and Sealed this

Thirtieth Day of June 1981

[SEAL]

*Attest:*

RENE D. TEGTMEYER

*Attesting Officer*

*Acting Commissioner of Patents and Trademarks*